United States Patent [19]

Bisping et al.

[11] Patent Number: 4,901,645

[45] Date of Patent: Feb. 20, 1990

[54] INERTIAL PROJECTILE HAVING A BREAKABLE PRE-PENETRATOR

[75] Inventors: Bernhard Bisping, Ratingen; Hermann Jansen, Essen; Peter Wallow, Düsseldorf, all of Fed. Rep. of Germany

[73] Assignee: Rheinmetall, GmbH, Duesseldorf, Fed. Rep. of Germany

[21] Appl. No.: 308,243

[22] Filed: Aug. 24, 1981

[30] Foreign Application Priority Data

Aug. 23, 1980 [DE] Fed. Rep. of Germany ..... 3031723

[51] Int. Cl.[4] ..... F42B 13/16

[52] U.S. Cl. ..... 102/521; 102/501; 102/517

[58] Field of Search ..... 102/501, 502, 506, 517–523, 102/529, 398, 491, 493, 364

[56] References Cited

U.S. PATENT DOCUMENTS

| | | | |
|---|---|---|---|
| 90,732 | 1/1869 | Curtis | 102/506 |
| 3,148,472 | 9/1964 | Hegge et al. | 102/521 X |
| 3,899,978 | 8/1975 | Luther et al. | 102/521 |
| 3,977,324 | 8/1976 | Stevenson et al. | 102/703 |
| 4,108,072 | 8/1978 | Trinks et al. | 102/518 |
| 4,281,599 | 8/1981 | Weber et al. | 102/518 |
| 4,362,107 | 12/1982 | Romer et al. | 102/529 X |

*Primary Examiner*—Harold J. Tudor
*Attorney, Agent, or Firm*—Klein & Vibber

[57] ABSTRACT

An improved inertial projectile arrangement including a subcaliber projectile penetrator which is composed of a prepenetrator portion with a nose point and a main penetrator portion. The penetrator has a large length-/diameter ratio and a high density. A sabot, composed of at least two segments, encompasses a part of the prepenetrator portion. The periphery of the encompassed prepenetrator and the sabot being joined to each other by form-locking means. The sabot segments separate from the penetrator upon exiting from the muzzle of the gun barrel from which the projectile is fired. The form-locking means are at least partially formed of irregularities or unevenesses on the periphery of the encompassed prepenetrator portion and the interior periphery of the sabot. A plurality of fracture zones and a transfer frusto-conical portion are disposed on the prepenetrator. The fracture zones achieve an intended breakup of the prepenetrator upon impact. A predetermined number of the fracture zones form part of the form-locking means. The frusto-conical transfer portion adjoins the fracture zone most distant from the nose point of the prepenetrator at one of its ends and the main penetrator portion at the other of its ends.

2 Claims, 1 Drawing Sheet

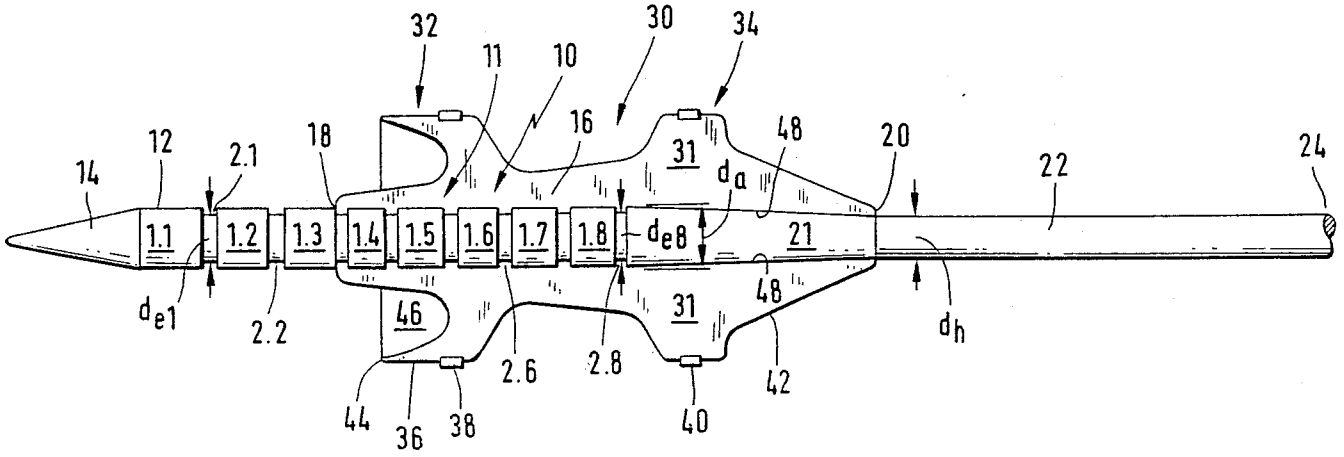
24
22
$d_h$
20
21
48
48
42
34
$d_a$
31
$d_{e8}$
31
40
30
1.8
2.8
16
10
1.7
2.6
11
1.6
38
32
1.5
46
36
1.4
44
18
1.3
2.2
2.1
1.2
12
1.1
$d_{e1}$
14

INERTIAL PROJECTILE HAVING A BREAKABLE PRE-PENETRATOR

BACKGROUND OF THE INVENTION

In our application Ser. No. 252,366, filed Mar. 25, 1981, there is described an inertial penetrator projectile which is effective against multi-plate-armored targets by virtue of the fact that the intended breakup of the penetrator increases the penetration capability of the inertial projectile. This intended breakup can be inhibited by the form-locking means which are arranged on the external periphery of the projectile in the connection zone between projectile and sabot.

SUMMARY OF THE INVENTION

It is an object of this invention, to avoid the aforedescribed inhibiting influence on the intended breakup or disintegration of the penetrator projectile, so that the entire avail able mass of the penetrator becomes "target-effective".

This object is attained in providing certain unevenesses on the external periphery of the projectile, which function as form-locking means and which have the dual function to simplify the manufacture of the projectile and to also lower the manufacturing costs. A transfer cone of the nose portion of the penetrator furnishes not only a long and impact-secure main penetrator portion, which, after penetration of the external armor is available against the main armor, but in a predetermined manner can be incorporated into the connection zone, and also makes for a high firing strength for the subcaliber projectile.

BRIEF DESCRIPTION OF THE DRAWING

Other objects and advantages of the invention will appear from the following detailed description of a preferred embodiment thereof, reference being made to the accompanying drawings in which The single FIGURE of the drawing illustrates a longitudinal schematic axial sectional view of an embodiment of the invention.

DESCRIPTION OF THE PREFERRED EMBODIMENT

The prepenetrator 11 of a projectile 10 has on its periphery 12 annular grooves (unevenesses) 2.1, . . . , 2.8 which are formed as fracture zones These annular grooves divide the prepenetrator into a plurality of sections 1.1, . . . , 1.8 of predetermined axial length which have an average exterior diameter $d_a$. The (core) diameter $d_{e1 \ldots 8}$ increases with the increasing distance from the nose point 14; in this manner there is attained an intentional breakup or disintegration whereby the breaking or disintegration tendency decreases from the nose 14 to the tail region 24 as the distance therefrom increases. A transfer cone 21 adjoins the last annular groove 2.8. The largest exterior diameter of the transfer cone corresponds to $d_a$ whereas the smallest exterior diameter corresponds to $d_h$ which is equal the diameter of the main penetrator 22. The tail section of the main penetrator is only schematically illustrated by means of the tail region 24; therefore the stabilizing guides which are generally mounted on the outer periphery of the tail section are not illustrated. The length and smallest diameter $d_h$ of the transfer cone 21 are set at predetermined limits. It has been found that as largest diameter the diameter $d_a$ corresponding to the diameter of the main penetrator portion 11 is most suitable. A detachable sabot 40 having 4 segments 31 is coaxially mounted on the projectile. Only two of the four segments 31 have been illustrated for purposes of clarity. The sabot has a forwardly disposed flange 32 and a rearwardly disposed flange 34. The flanges 32 and 34 are respectively armed with guide rings or bands 38 and 40. The band 40 functions as a sealing band which is adjoined at its rear side by a rearwardly extending gas pressure receiving surface 42. An air pocket 46 is formed at the forward edge 44 of the sabot 30, which air pocket favors the separation of the sabot 30 from the projectile 10 due to the effect of the air barriers forming in front of the projectile after the projectile assembly has left the muzzle of the gun barrel. The segments 31 of the sabot 30 have interior unevenesses which have not been illustrated in detail. The unevenesses on the segments 31 interdigitate with unevenesses (annular grooves 2.3 to 2.8) on the periphery of the main penetrator portion 11 and a connection zone 16. This zone extends between a forward edge 18 and a rear edge 20, so that the transfer cone 21 is completely encompassed in the connection zone 16.

The gas pressure receiving surface 42 is loaded after firing and during the firing process by means of the propellant gases which form during such firing process. The energy resulting from this firing process is, during the movement of the projectile assembly within the gun barrel, in view of the mutual form-locking in the connection zone 16, reliably transferred onto the projectile 10 proper. In view of a radially inwardly acting pressure component, which forms during the gun barrel traverse of the projectile assembly, there is advantageously obtained a firing strength, due to the interaction between the transfer cone 21 with an inner peripheral surface 48 of the segments 31 (not illustrated in detail) which tightly interengage and thereby act as form-locking element, so as to substantially contribute in the illustrated form to the firing strength while assuring a large penetrator length. This has a particularly favorable effect in view of the high density of the penetrator material for example a heavy metal-sinter-alloy such as, for example, alloys having a tungsten basis respectively an enriched uranium basis. Thus not only is a large penetrator mass brought to the target, but when it impacts, thanks to the shape of the projectile in accordance with the invention, it is optimally effective at penetration particularly on multi-plated targets over its entire projectile length.

The core diameter $d_{e1 \ldots 8}$ and the length of the sections 1.1 . . . 1.8 but also the cross-sectional shapes of the unevenesses 2.1 . . . 2.8 may advantageously be varied in different ways thereby be adapted to a plurality of conditions determined by the target.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. An improved inertial projectile arrangement for a barrel type weapon comprising a subcaliber penetrator projectile, which penetrator has a pre-penetrator portion with a nose point, a main penetrator portion, a large length diameter ratio and a high density, and having a segmented sabot of predetermined mass which sabot detaches itself from the penetrator in the form of at least two sabot segments, which sabot and penetrator being axially coextensive over a predetermined axial length forming a connection zone, the peripheral surface of the penetrator and inner peripheral surface of the sabot having surface irregularities which coact with each other to form form-locking means between the sabot and penetrator, the penetrator having a plurality of fracture zones for achieving an intended breakup of the penetrator upon impact at said fracture zones, the improvement comprising, a predetermined number of said fracture zones forming a part of said form-locking means, said prepenetrator portion having a transfer frusto-conical portion having a maximum diameter and minimum diameter which adjoins the fracture zone most distant from the nose point of the prepenetrator portion at one end of its axial extent where it has the maximum diameter and the main penetrator portion at its other axial extent where it has the minimum diameter.

2. The improvement in an inertial projectile arrangement as defined in claim 1, wherein said transfer frusto-conical portion forms a predetermined part of said connection zone.

* * * * *